United States Patent [19]

Siwiak et al.

[11] 4,086,591

[45] Apr. 25, 1978

[54] SMALL APERTURE ANTENNA

[75] Inventors: Kazimierz Siwiak, Waltham, Mass.; Robert L. Moran, Rand, Colo.

[73] Assignee: Raytheon Company, Lexington, Mass.

[21] Appl. No.: 728,109

[22] Filed: Sep. 28, 1976

[51] Int. Cl.[2] ..... H01Q 1/42; H01Q 17/00

[52] U.S. Cl. ..... 343/18 A; 343/18 B; 343/784; 343/872

[58] Field of Search ..... 343/18 A, 18 B, 784, 343/872, 873

[56] References Cited

U.S. PATENT DOCUMENTS

| | | | |
|---|---|---|---|
| 2,841,786 | 7/1958 | Dicke | 343/18 A X |
| 3,101,473 | 8/1963 | Fenlon, Jr. | 343/18 B X |
| 3,396,400 | 8/1968 | Kelly et al. | 343/872 |
| 3,560,986 | 2/1971 | Hoots et al. | 343/872 |
| 3,611,396 | 10/1971 | Jones, Jr. | 343/784 X |

*Primary Examiner*—Malcolm F. Hubler

*Attorney, Agent, or Firm*—Philip J. McFarland; Joseph D. Pannone

[57] ABSTRACT

A device for reducing the backlobe radiation from small aperture antennas is shown to comprise a thin hemispherical radome having both radio frequency energy absorbing and reflecting materials attached thereto. The absoring material dissipates a portion of the edge currents existing on the antenna aperture, while the reflecting material intercepts a portion of the energy radiated from the antenna and reflects that portion back to the edge of the antenna to produce destructive interference with the edge currents.

6 Claims, 11 Drawing Figures

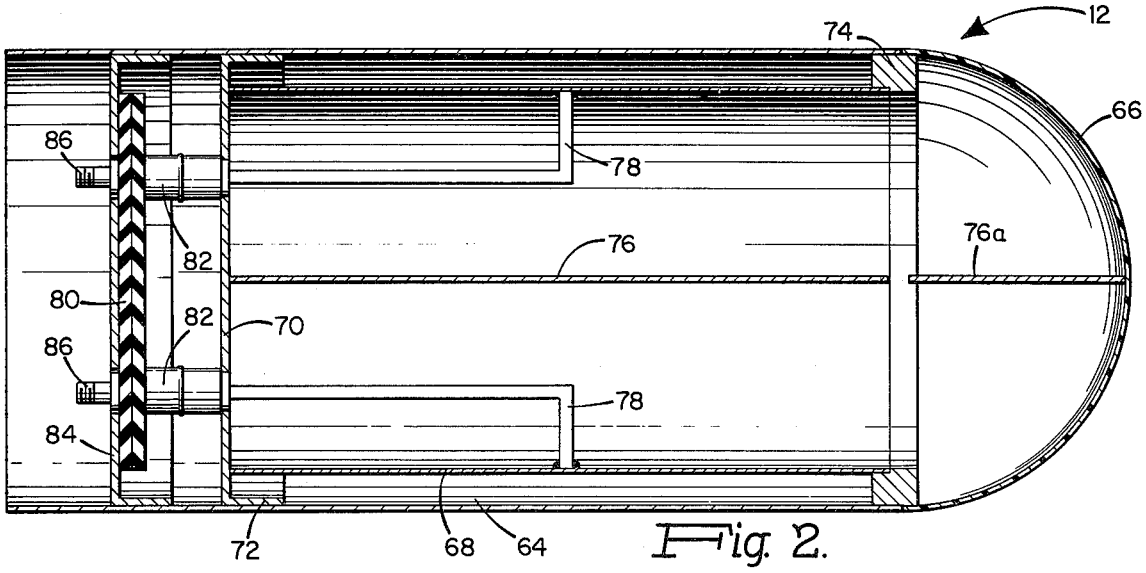
Fig. 2.
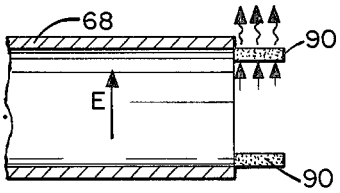
Fig. 4A.
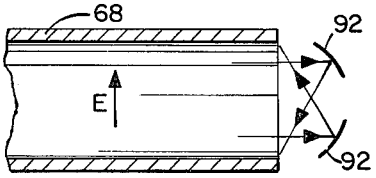
Fig. 4C.
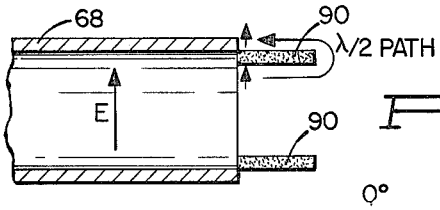
Fig. 4B.
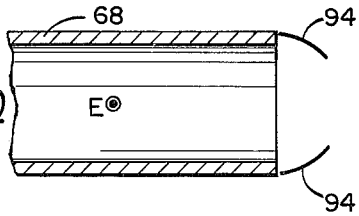
Fig. 4D.
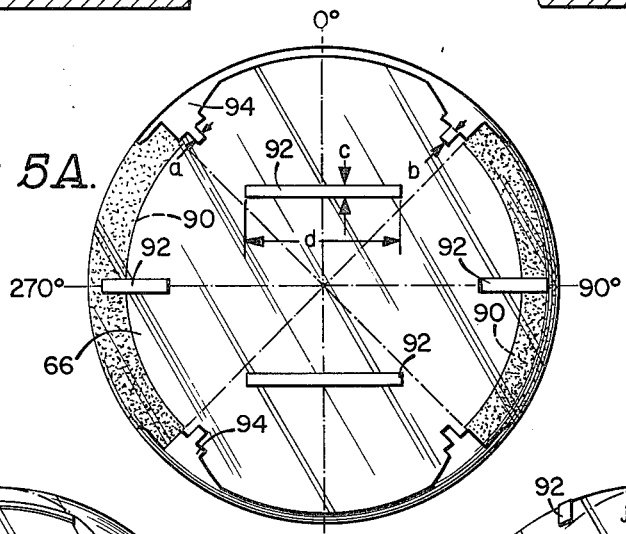
Fig. 5A.
Fig. 5B
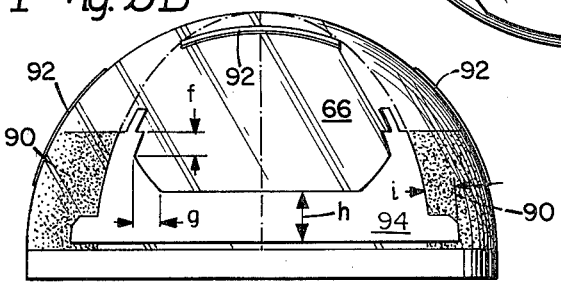
Fig. 5C.
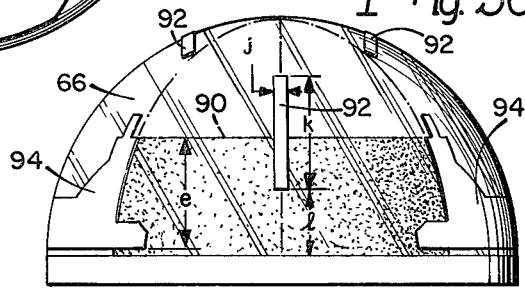

SMALL APERTURE ANTENNA

BACKGROUND OF THE INVENTION

This invention relates generally to small aperture antennas and in particular to devices for reducing the backlobe radiation from such antennas.

The recent conflict in Southeast Asia has demonstrated that aircraft are particularly susceptible to attack from the rear either by surface-to-air missiles, or air-to-air missiles, or by hostile aircraft. Obviously then, a tail warning radar system, which will provide the pilot with warning of attacks from the rear in sufficient time to initiate countermeasures deployment and employ either engaging or evasive tactics, is desirable. The antenna for such a radar system should provide a broad radiation pattern directed to the rear of the aircraft and sould be capable of providing both a sum and difference pattern so that the position, either to the left or right of the aircraft centerline, of the attacker can be determined. In addition, the radar system should be designed to maximize missile detections at all closing velocities, including closing velocities less than aircraft speed. As at low altitudes ground clutter returns can enter the radar system with the same Doppler frequencies as targets of interest, an antenna with low backlobes is required to reduce the sensitivity of the radar system to clutter returns. In fact, backlobe levels on the order of 40 dB below the beam peak are required if targets with closing velocities less than the aircraft velocity are to be detected.

While there exists many prior art methods of controlling the backlobe radiation of antennas, none are particularly well suited for airborne applications where, as here, the allowable packaging volume is severely limited. Thus, antennas utilizing multimode apertures (as, for example, a scalar horn antenna) can provide low backlobe radiation, but they are much too large. Traveling wave antennas such as dielectric rod antennas, log periodic antennas, or slot array antennas can provide the 40 dB backlobe levels required, but their main lobe beamwidths are much too narrow and their length becomes excessive for aircraft tail mounting applications.

Other prior art methods of reducing undesired backlobe radiation include the use of chokes around the aperture of the antenna. While chokes may be effective in reducing the backlobe radiation for the antenna sum pattern, their effect on the antenna difference pattern backlobes is not as pronounced.

A circular waveguide radiator, having an effective aperture of approximately $0.82\lambda$, where $\lambda$ is the wavelength of the centerband frequency of the antenna, was chosen as the optimum antenna design for the given application. While such an antenna has the broad beamwidth required, and provides a rugged assembly suitable for aircraft applications, its backlobe radiation is only approximately 20 dB below that of the beam peak. Obviously then, a means for reducing both the sum and difference pattern backlobes from such an antenna is required.

SUMMARY OF THE INVENTION

With this background of the invention in mind, it is an object of this invention to provide a device for reducing the backlobe radiation of small aperture antennas.

Another object of this invention is to provide an antenna especially suited for a tail warning radar system for a high performance aircraft.

These and other objects of the invention are attained generally by providing a backlobe suppression device for small aperture antennas comprising a thin hemispherical radome, having a layer of radio frequency (RF) absorbing material protruding approximately one-quarter wavelength, at the center band frequency, into selected quadrants of the radome. Energy scattering means are provided on portions of said radome to further reduce the backlobe radiation. A metallic mounting ring is also provided for mounting said radome to said antenna.

BRIEF DESCRIPTION OF THE DRAWINGS

The foregoing features of this invention, as well as the invention itself, may be more fully understood from the following detailed description read together with the accompanying drawings, in which:

FIG. 2 is a cross-sectional drawing, partially cutaway, of the antenna of FIG. 1;

FIGS. 4A to 4D are simplified sketches useful in illustrating the techniques used to reduce the backlobe radiation from the antenna of FIG. 1; and FIGS. 5A to 5C are simplified sketches of the radome for the antenna of FIG. 1.

DESCRIPTION OF THE PREFERRED EMBODIMENT

Figure 1:
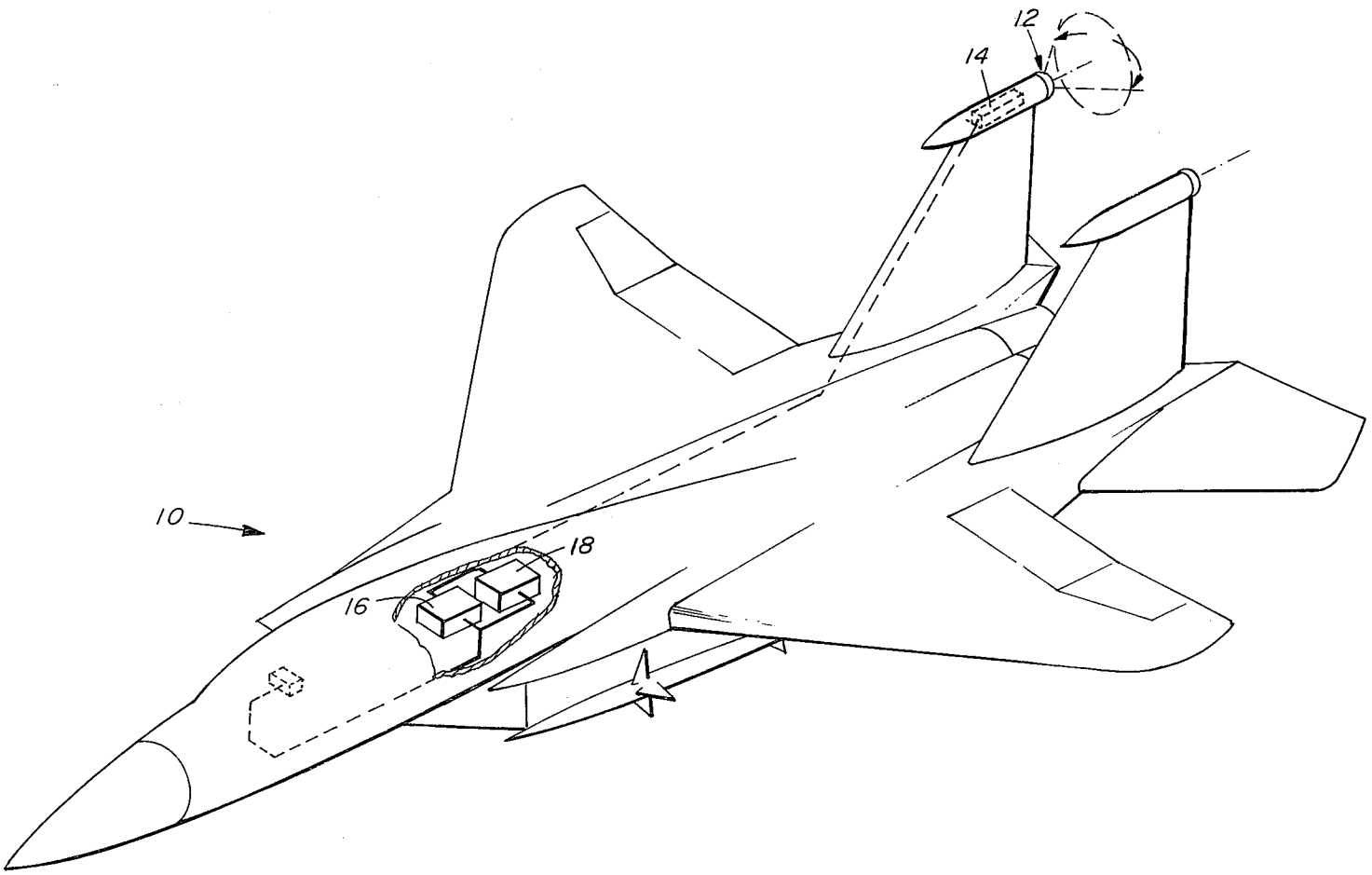
FIG. 1 is a simplified sketch of an aircraft illustrating the location of an antenna for use in a tail warning radar system.

Referring now to FIG. 1, an aircraft 10 having a tail warning radar system is shown to include an antenna/radome assembly 12, and a preamplifier assembly 14, both of which are mounted in the vertical tail assembly 16 of aircraft 10. Radio frequency signals received by antenna/radome assembly 12 are down-converted to suitable IF signals in preamplifier assembly 14. Signals from preamplifier assembly 14 are sent via coaxial cables (not numbered) to receiver processor 18, located in the forward section of aircraft 10. Also included in the forward section of aircraft 10 is a transmitter assembly 20.

Figure 1A:
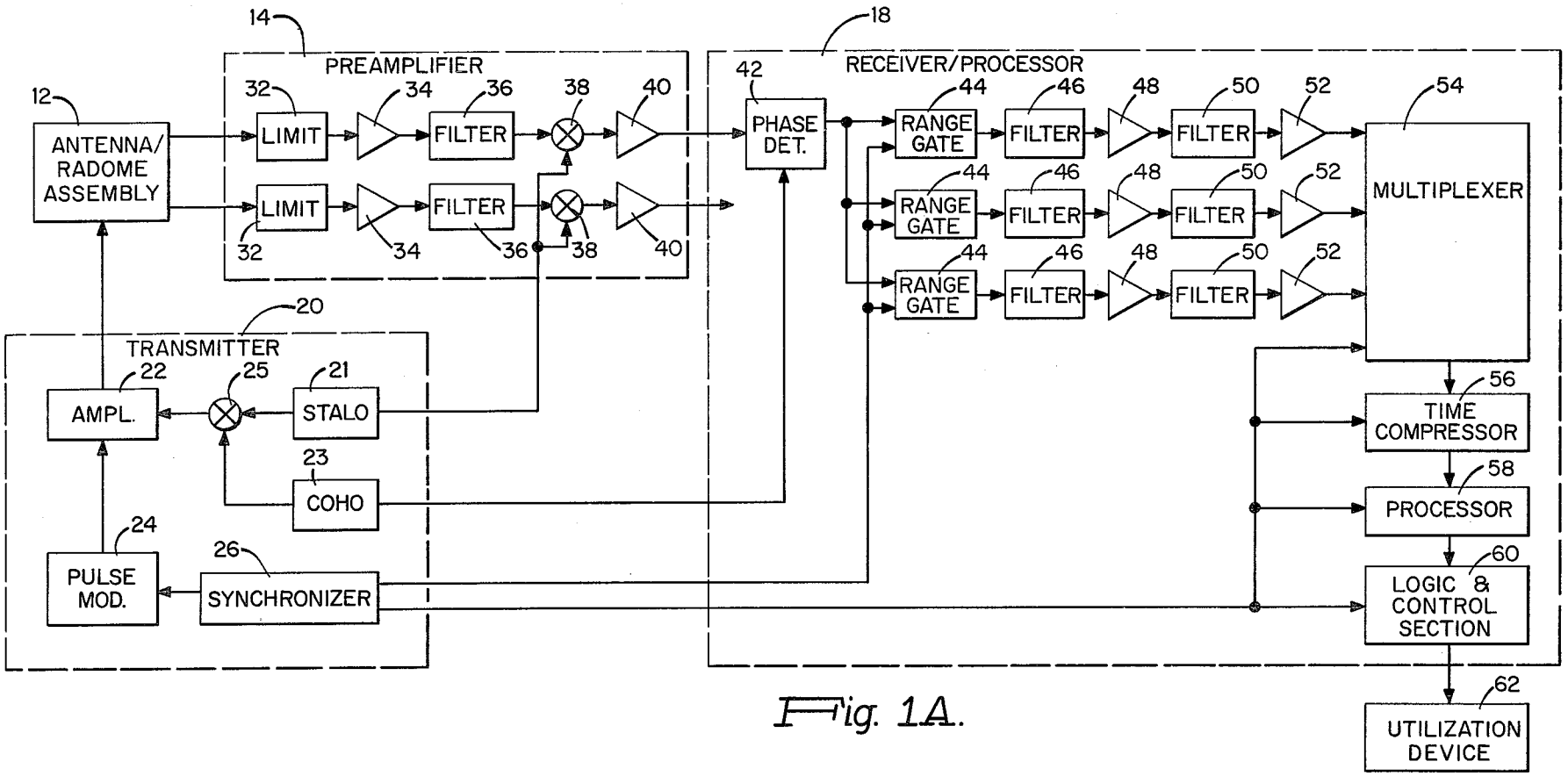
FIG. 1A is a simplified block diagram of a tail warning radar system.

Referring now to FIG. 1A, transmitter assembly 20 is shown to include an amplifier, here a klystron amplifier 22, a pulse modulator 24, and a synchronizer 26, arranged in a conventional manner to produce a train of pulses which are transmitted by antenna/radome assembly 12, the details of which will be explained in greater detail hereinafter. Suffice it to say here that antenna/radome assembly 12 includes a circulator (not shown) for separating the transmitted signals from the received signals. Each one of the pulses in the train of transmitted pulses is reflected by various objects which are dispersed over various ranges from antenna/radome assembly 12. A portion of the reflected energy produced in response to each transmitted pulse is received by the antenna/radome assembly 12 and is processed, in a manner to be described in greater detail hereinafter, to produce sum ($\Sigma$) and azimuth difference ($\Delta A_Z$) signals which are passed to preamplifier assembly 14. Preamplifier assembly 14 is of conventional design and includes limiters 32 to protect preamplifiers 34. The output signals from preamplifiers 34 are passed through a pair of image rejection bandpass filters 36 and then are heterodyned in a conventional manner in mixers 38 with a signal produced by stable local oscillator (STALO 21). The signal produced by STALO 21 is heterodyned with a signal produced by a coherent oscillator (COHO 23) in a mixer 25 to produce a signal which is amplified by klystron amplifier 22 in a conventional manner. The signals produced at the output of mixers 38 are passed through IF amplifiers 40 to receiver/processor 18. Receiver/processor 18 is a two-channel unit, but only a single channel, corresponding to the Σ channel, is shown for the sake of clarity.

The input signals to receiver/processor 18 are passed to a phase detector 42. Phase detector 42 responds in a conventional manner to the signal produced by COHO 23 whereby the output signal from such phase detector 42 is a video frequency signal. The video frequency signal is applied to three range gates 44. Each one of the range gates 44 is actuated at a different predetermined time after each one of the transmitted pulses in response to a signal supplied by synchronizer 26. Each one of the range gates 44 is followed by an image reject filter 46, an amplifier 48, a clutter reject filter 50, and an amplifier 52, all of which are of conventional design. The signals from amplifiers 52 are time multiplexed into a single channel in multiplexer 54 in response to control signals produced by synchronizer 26. The time multiplexed signals are passed to a time compressor which provides Doppler filtering of the signals in a conventional manner. The output signals from time compressor 56 are passed to a processor 58 which provides both post detection integration and separation of the data into both velocity and acceleration channels. The data from processor 58 is passed to logic and control section 60 wherein the data undergoes the post-processing logic necessary to classify targets, reject false alarms, and give an indication of the position of the target relative to the centerline of aircraft 10. The output signal from logic and control section 60 is sent to a utilization device 62, here located in the cockpit of aircraft 10. Utilization device 62 provides the pilot with an audio signal when a target is detected as well as a visual signal indicating the position of the target.

Referring now to FIG. 2, the antenna radome assembly 12 is shown to include a hollow metal cylinder 64 (sometimes hereinafter referred to simply as cylinder 64), one end of which has a hemispherical radome 66 attached thereto. Included within cylinder 64 is a circular waveguide section 68. The rear end of circular waveguide section 68 is mounted to cylinder 64 by means of a support plate 70 having a flange 72. The front end of circular waveguide section 68 is mounted to cylinder 64 by means of a mounting ring 74. Radome 66 is also attached, here by means of a suitable epoxy, to mounting ring 74. Circular waveguide section 68 is bifurcated by a thin metal septum 76 (sometimes hereinafter referred to as septum 76) so as to form two half sections required to provide an antenna difference pattern. A second septum 76a is included within radome 66. The antenna sum pattern is obtained by feeding each half section out-of-phase. The $TE_{11}$ mode is excited in each half section by means of loop couplers 78 which are terminated on the wall of circular waveguide section 68. The loop couplers 78 are fed by means of a conventional stripline arithmetic unit 80. The loop couplers 78 are coupled to stripline arithmetic unit 80 by means of "snap-on" coaxial connectors 82 which are also of conventional design. The stripline arithmetic unit 80 is mounted to cylinder 64 by means of a second flanged support plate 84. Stripline-to-coax connectors 86 are provided on the rear of stripline arithmetic unit 80 for mating with coaxial cables (not shown) which are, in turn, connected to a circulator (not shown). It should be noted that only the sum channel signals are routed through the circulator.

Figure 3B:
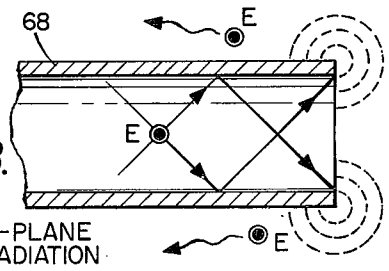
FIGS. 3A to 3B are simplified sketches useful in understanding the causes of backlobe radiation from the antenna of FIG. 1.
Figure 3A:
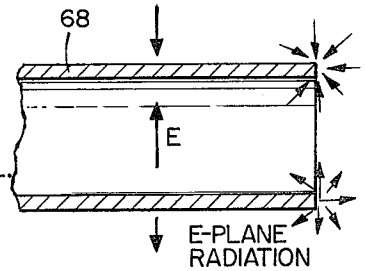

The principal source of backlobe radiation from the justdescribed antenna is radiation from edge currents existing at the end of circular waveguide section 68. This phenomenon is illustrated in FIGS. 3A and 3B for E-plane and H-plane radiation, respectively. The backlobe radiation may be reduced by the dissipation of these edge currents. One method, shown in FIG. 4A, of reducing these edge currents is the placement of RF absorbing material 90 at the end of circular waveguide section 68. Even greater cancellation of the edge currents may be obtained by means of controlling the length of the absorbing material 90, as shown in FIG. 4B. In this configuration, the current which travels around the inner and outer surfaces of the RF absorbing material 90 arrives at the edge of circular waveguide section 68 directly out-of-phase with that portion of the current which passes directly though the RF absorbing material 90, resulting in destructive interference. Still another method of reducing edge currents by means of destructive interference is shown in FIG. 4C, wherein a portion of the radio frequency energy radiated from circular waveguide section 68 is intercepted by small metal reflectors 92, located on radome 66 (FIG. 2), and reflected back to the edge of circular waveguide section 68. Reflectors 92 are positioned so that the reflected energy traverses a pathlength of one-half wavelength and therefore arrives at the edge of circular waveguide section 68 directly out-of-phase with the energy directly incident thereon. The just-described methods are effective in reducing the backlobes due to E-plane radiation. To reduce the backlobe radiation attributable to H-plane radiation, metal strips 94 (which are shorted to circular waveguide section 68 as shown in FIG. 4D) are provided on the H-plane quadrants of radome 66 (FIG. 2).

Referring now to FIGS. 5A, 5B and 5C, radome 66 employing the described techniques for reducing backlobe radiation will be described. For purposes of orientation, septum 76a (FIG. 2) is located in a plane through the 0° and 180° reference angles. The H-plane quadrants of radome 66 extend ± 45° about the 90° and 270° reference angles. Metal strips 94, for suppressing the backlobe radiation attributable to H-plane radiation, are attached in any convenient manner, here by means of a suitable epoxy, to the H-plane quadrants of radome 66 on the outer surface of such radome. The metal strips 94 are grounded to mounting ring 74 (FIG. 2) by means of small metal straps (not shown). The shape of the metal strips 94 was empirically determined from antenna pattern measurements taken with the antenna/radome assembly 12 mounted in a scale model of the aircraft tail assembly 14 (FIG. 1).

The RF absorbing material 90 used to suppress the E-plane radiation comprises two layers (each being 0.250 inches thick) of ECCOSORB AN-72 material manufactured by Emerson-Cummings, Inc., Canton, Massachusetts. The conductive surface of one layer is in contact with radome 66 and the conductive surface of the other layer is in contact with the nonconductive surface of the first layer. The two layers are bonded together in any convenient manner, here by means of a suitable epoxy. The bonded layers are attached to the inner surface of radome 66 in those sections of radome 66 which correspond to the E-plane quadrants. Metal reflectors 92, which are used to provide additional suppression of E-plane radiation, are shown to be located on the outside surface of radome 66 in each of the four quadrants of radome 66. The size and location of each of the metal reflectors 92 was determined empirically.

The radome 66 including RF absorbing material 90, metal reflectors 92 and metal strips 94 has been built and found effective to reduce both the sum and difference pattern backlobe radiation by approximately 20 dB. The parameters used were:

Dimension $a$ = 0.125 inches
Dimension $b$ = 0.265 inches
Dimension $c$ = 0.160 inches
Dimension $d$ = 1.500 inches
Dimension $e$ = 1.875 inches
Dimension $f$ = 0.350 inches
Dimension $g$ = 0.570 inches
Dimension $h$ = 1.00 inches
Dimension $i$ = 0.775 inches
Dimension $j$ = 0.100 inches
Dimension $k$ = 1.450 inches
Dimension $l$ = 1.100 inches
Inside radius of radome = 3.00 inches Having described an embodiment of this invention, it will now be apparent to one of skill in the art that many changes may be made without departing from our inventive concepts. It is felt, therefore, that the invention should not be restricted to its disclosed embodiment but rather should be limited only by the spirit and scope of the appended claims.

What is claimed is:

1. A device for reducing the backlobe radiation from a small aperture antenna wherein such radiation is caused by radio frequency currents excited on the edge of said antenna, such device comprising:

(a) a radome attached to the edge of the antenna and completely enclosing the radiating end of said antenna;

(b) means, mounted to the radome, for absorbing a portion of the radio frequency currents;

(c) means, disposed on the surface of the radome, for suppressing a portion of the energy radiated from the edge of the antenna; and, (d) means, mounted to said radome, for reflecting a portion of the radio frequency energy radiated from the antenna back to the edge of said antenna.

2. The device as recited in claim 1 wherein said absorbing means comprises a double layer of radio frequency absorbing material mounted to the inner surface of said radome in those quadrants corresponding to the E-plane quadrants of said radome.

3. The device as recited in claim 1 wherein said suppressing means comprises metal strips mounted on the H-plane quadrants of the radome and grounded to the outer surface of said antenna.

4. The devce as recited in claim 1 wherein said reflecting means comprises this metal strips mounted on the surface of said radome, at least one of said strips being located in each quadrant of said antenna.

5. The device as recited in claim 2 wherein said absorbing material extends along the inner surface of the radome for a distance of $\lambda/4$ (where $\lambda$ is the operating wavelength of the antenna).

6. The device as recited in claim 4 wherein the pathlength traveled by the energy radiated from the antenna and reflected from said metal strips back to the edge of the antenna is equal to $\lambda/2$ (where $\lambda$ is the operating wavelength of the antenna).

* * * * *